US005925840A

United States Patent [19]

Senn

[11] Patent Number: 5,925,840

[45] Date of Patent: Jul. 20, 1999

[54] MALLET FOR PERCUSSION INSTRUMENTS

[76] Inventor: Friedrich Senn, Gottlieber Str. 23, 78462 Konstanz, Germany

[21] Appl. No.: 08/870,183

[22] Filed: Jun. 6, 1997

[30] Foreign Application Priority Data

Jun. 7, 1996 [DE] Germany ..... 296 10 013 U

[51] Int. Cl.[6] ..... G10D 13/02

[52] U.S. Cl. ..... 84/422.4

[58] Field of Search ..... 84/422.4

[56] References Cited

U.S. PATENT DOCUMENTS

| | | | |
|---|---|---|---|
| 3,175,450 | 3/1965 | Criscuolo | 84/422.4 |
| 3,901,384 | 8/1975 | Lee et al. | 206/314 |
| 4,545,836 | 10/1985 | Lidster | 156/185 |
| 4,898,061 | 2/1990 | Cohen et al. | 84/402 |
| 5,263,395 | 11/1993 | Phillips | 84/422.4 |
| 5,693,900 | 12/1997 | Calato et al. | 84/422.4 |

*Primary Examiner*—William M. Shoop, Jr.
*Assistant Examiner*—Shih-yung Hsieh
*Attorney, Agent, or Firm*—Bachman & LaPointe, P.C.

[57] ABSTRACT

A stick or mallet for percussion instruments having a rod on which a head is arranged, wherein the head consists of a reformable material as a reformable plastic.

4 Claims, 1 Drawing Sheet

MALLET FOR PERCUSSION INSTRUMENTS

BACKGROUND OF THE INVENTION

The present invention relates to a mallet for percussion instruments comprising a stick having a head.

By a mallet or mallets, there are understood instruments for striking percussion instruments. Generally they are wooden sticks of a thickness of 30 to 40 centimeters having a rounded end or terminating in a head, they being mainly used in pairs. Today, this head consists of sponge, felt, cork, wood, rubber, or the like. Sticks with heads consisting of rubber or wood weigh a lot and are very top-heavy so that the striking tone has an undesired rubber-like sound or is too hard. The same is true also in the case of leather, since a wooden head is generally covered by leather or felt. A stick having a head of sponge is, on the other hand, too light, so that once again the striking tone is impaired. A head of solid rubber, furthermore, is of poor vibrational behavior since it is initially flexible, i.e. yields upon striking, but then becomes harder. This impairs the vibration.

The object of the present invention is to provide a stick or mallet of the aforementioned type, the striking behavior and handling of which are improved.

SUMMARY OF THE INVENTION

In order to achieve this object, the head consists of a reformable plastic. This reformable plastic should be easily deformable but reformable and resilient. In particular, there can be used here a head of polyethylene or of polyethylene foam, the head being at the same time made substantially lighter and having a negligible weight. The polyethylene foam is preferably roughened.

BRIEF DESCRIPTION OF THE DRAWINGS

The present invention will be more readily understood from a consideration of the accompanying drawings in which.

DETAILED DESCRIPTION OF PREFERRED EMBODIMENTS

A stick head having these properties has the advantage that, upon playing a drum, when the head of the drumstick strikes the skin of the drum, the skin is compressed and its striking surface thereby enlarged. If the hardness of the strike is increased, then the striking surface is enlarged, whereby a certain damping effect is produced. At the same time, the sound is louder, but softer and fuller as a result of the damping effect. If the strength of the striking is reduced to a minimum, then the striking surface is also minimum, which results in a hard, very clear and precise striking sound.

In this way, a balanced tonal behavior over the different dynamic stages can be obtained, a pronounced spring action resulting between the head of the drumstick and the skin of the drum so that, utilizing this spring action, for example, also a double roll can be easily produced.

In another embodiment of the invention, the head is to consist of rubber cork. In this way, the two favorable properties of cork and of rubber are combined with each other. The cork is relatively light but hard, while the rubber, in its turn, is flexible. In other words, a stick of rubber cork combines the good properties of the two materials. The weight is reduced and, at the same time, the striking becomes more precise. This last-mentioned stick is suitable, in particular, for xylophones.

In another embodiment of the invention, it is provided that the head has a flocked covering. A flocked covering of a suitable material results in a softer strike, so that the striking tone is substantially improved. The same result can also be obtained with a suitable textile material.

Figure 1:
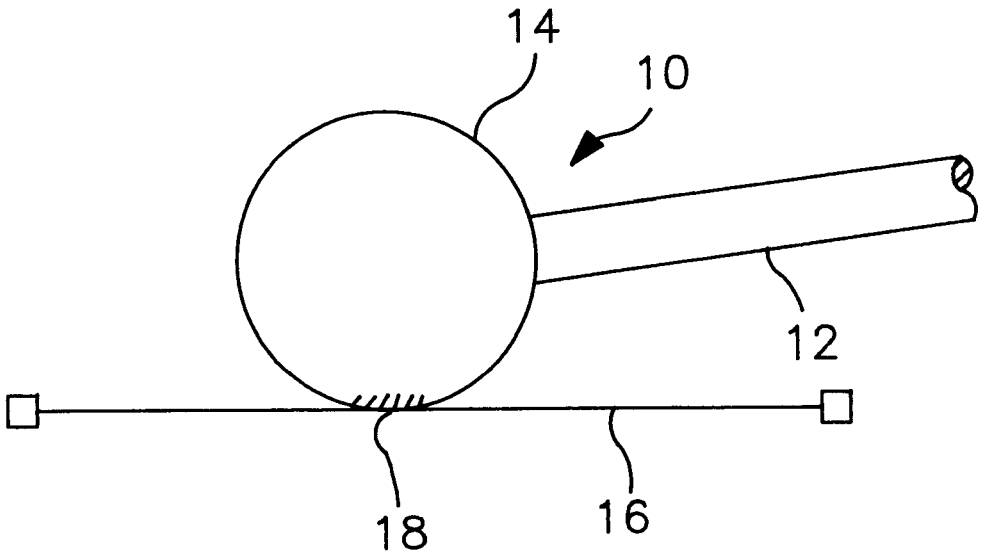
FIGS. 1 and 2 show the mallet of the present invention striking a contact surface.
Figure 2:
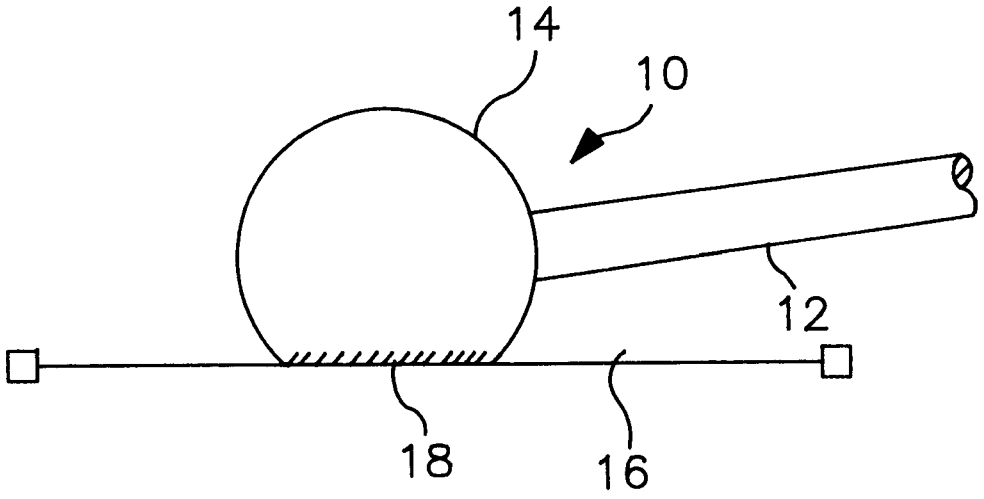

Referring to the drawings, FIGS. 1 and 2 shows a mallet 10 of the present invention including rod 12 and head 14 attached thereto. The mallet 10 strikes the contact surface 16 with striking surface 18 and is compressed as shown in FIGS. 1 and 2 with its striking surface 18 enlarged.

I claim:

1. A stick or mallet for a percussion instrument, which comprises a rod which terminates in a head, wherein the head is at least in part reformable material and wherein the reformable material is polyethylene foam.

2. A stick or mallet for a percussion instrument, which comprises a rod which terminates in a head, wherein the head is at least in part reformable material and wherein the reformable material is rubber cork.

3. A stick or mallet for a percussion instrument, which comprises a rod which terminates in a head, wherein the head is at least in part reformable material and wherein the head has a center of rubber cork and an outer layer of reformable plastic.

4. A stick or mallet for a percussion instrument, which comprises a rod which terminates in a head, wherein the head is at least in part reformable material and wherein the head has a center of rubber cork and an outer layer of a textile material.

* * * * *